United States Patent [19]

Davis

[11] 4,231,757

[45] Nov. 4, 1980

[54] NITRO PHENOL-AMINE CONDENSATES, METHODS OF MAKING SAME, FUELS AND ADDITIVE CONCENTRATES CONTAINING THEM

[75] Inventor: Kirk E. Davis, Euclid, Ohio

[73] Assignee: The Lubrizol Corporation, Wickliffe, Ohio

[21] Appl. No.: 911,728

[22] Filed: Jun. 2, 1978

[51] Int. Cl.[2] ..... C10L 1/22

[52] U.S. Cl. ..... 44/63; 252/51; 564/305; 564/315; 564/426; 564/427; 564/428; 564/430; 564/432; 564/441; 564/443

[58] Field of Search ..... 44/63; 260/571; 252/51

[56] References Cited

U.S. PATENT DOCUMENTS

| | | | |
|---|---|---|---|
| 3,929,889 | 12/1975 | Squire | 260/571 |
| 4,001,260 | 1/1977 | Del Pesco | 260/571 |

FOREIGN PATENT DOCUMENTS 963263 7/1964 United Kingdom .

OTHER PUBLICATIONS

Huang-Minlon, "The Reaction of Hydrazine Hydrate on Nitro-Compounds and a New Route to Synthetic Oestrogens," Journal of the American Chemical Society, vol. 70, pp. 2802-2805, 1948.

"Hydrazine as a Reducing Agent for Organic Compounds," Chemical Reviews, vol. 65, pp. 51 et seq.

*Primary Examiner*—Winston A. Douglas
*Assistant Examiner*—J. V. Howard
*Attorney, Agent, or Firm*—Daniel N. Hall; William H. Pittman; Raymond F. Keller

[57] ABSTRACT

Nitrogen-containing compositions made by condensing a nitro phenol with an organic amino compound having at least one hydrogen atom directly bonded to a nitrogen or oxygen atom are useful as additives for lubricants and fuels. A specific embodiment comprises compositions made by reacting nitro phenols having hydrocarbyl substituents of up to 750 aliphatic carbon atoms with alkylene polyamines.

45 Claims, No Drawings

NITRO PHENOL-AMINE CONDENSATES, METHODS OF MAKING SAME, FUELS AND ADDITIVE CONCENTRATES CONTAINING THEM

BACKGROUND OF THE INVENTION (1) Field of the Invention

This invention relates to compositions useful as additives for lubricants based on oils of lubricating viscosity and for normally liquid fuels. More particularly, it relates to nitrogen-containing compositions made by condensing nitro phenols with an amino compound containing a hydrogen atom bonded directly to a nitrogen or oxygen atom and the use of such products in lubricants, fuels and additive concentrates.

(2) Prior Art

U.S. Pat. No. 3,929,889 describes the production of aromatic amines by reacting aromatic compounds such as benzene with ammonia in the presence of certain nickel/nickel oxide "cataloreactants" at temperatures of 150°-500° C.

British Pat. No. 963,263 describes the reaction of alkyl hydroxy aromatic compounds with alkylene polyamines and the use of such products in internal combustion engine fuels.

(3) General Background

The improvement of the performance characteristics of lubricants based on oils of lubricating viscosity (e.g., engine oils, transmission oils, industrial oils, greases and the like) and normally liquid fuels (gasoline, diesel fuels, middle distillate heating oils, jet fuels, kerosenes, residual fuels, etc.) through the use of additives has been known for several decades. The present day pressures of increasing material shortages (particularly shortages of petroleum-based products), spiraling equipment replacement costs, and environmental consciousness, have led to renewed efforts in the search for new, effective, alternate, lubricant and fuel additives.

(4) Objects

Therefore, it is an object of this invention to provide novel compositions that impart useful and desirable properties to lubricants based on oils of lubricating viscosity and to normally liquid fuels.

It is further an object of this invention to provide novel additive concentrates and lubricants and fuels compositions containing the nitrogen-containing compositions of this invention.

A still further object is to provide methods for making such compositions.

Other objects will be apparent to those of skill in the art or become apparent upon review of the present specification.

SUMMARY OF THE INVENTION

This invention comprises nitrogen-containing compositions made by condensing:

(A) at least one nitro phenol represented by the formula

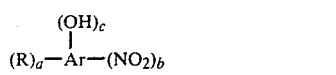

Formula I wherein R is a substantially saturated, substantially hydrocarbyl, nonaromatic substituent bonded to an aromatic ring carbon of Ar through a direct carbon bond; a is zero or an integer of 1 up to three times A where A is the number of aromatic nuclei present in Ar; b and c are each independently integers of 1 up to three times A with the proviso that the sum a+b+c does not exceed the unsatisfied valences of Ar; and Ar is an aromatic moiety having 0 to 3 optional substituents, Opt, selected from the group consisting of halogen, —L, —OL, —CN, —$NH_2$, —NHL, —$NL_2$, —C(O)OL where L is a lower alkyl group of 1 to 7 carbon atoms and combinations of two or more of any of said optional substituents, with (B) at least one amino compound having at least one hydrogen atom directly bonded to a nitrogen atom or to an oxygen atom.

The term "phenol" is used in this specification and the appended claims in its art-accepted generic sense to describe hydroxy aromatic compounds having at least one hydroxyl group bonded directly to a carbon of an aromatic ring. Similarly, the term "nitro phenol" is used in its generic sense to refer to phenols having at least one nitro group ($NO_2$—) directly bonded to a carbon which is part of an aromatic ring. "Aromatic" is similarly used in its art-accepted generic sense to describe cyclic structures exhibiting pi-electron orbital delocalization and thus embraces both carbocyclic and heterocyclic ring structures.

Lubricants, based on oils of lubricating viscosity, normally liquid fuels and additive concentrates based on substantially inert solvent/diluents, as described hereinbelow, containing the above-described nitrogen-containing compositions are within the scope of the invention.

DESCRIPTION OF THE INVENTION

(A) The aromatic moiety, Ar.

The aromatic moiety, Ar, can be a single aromatic nucleus such as a benzene nucleus, a pyridine nucleus, a thiophene nucleus, a 1,2,3,5-tetrahydronaphthalene nucleus, etc., or it can be a polynuclear aromatic moiety. Such polynuclear moieties can be of the fused type wherein an aromatic nucleus is fused at two points to another nucleus such as found in naphthalene, anthracene, azanaphthalene, etc., moieties. Polynuclear aromatic moieties also can be of the linked type wherein at least two nuclei (either mono- or polynuclear) are linked through bridging linkages to each other. Such bridging linkages can be chosen from the group consisting of carbon-to-carbon single bonds, ether linkages, keto linkages, sulfide linkages, polysulfide linkages of 2 to 6 sulfur atoms, sulfinyl linkages, sulfonyl linkages, alkylene linkages, alkylidene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between two aromatic nuclei. For example, a fluorene nucleus has two benzene nuclei linked by both a methylene linkage and a covalent bond. Normally, Ar will contain only carbon atoms in the aromatic nuclei per se although in certain Ar moieties heterocyclic nuclei such as pyridyl, thienyl and furanyl nuclei can be present.

The number of aromatic nuclei, fused, linked or both, in Ar determines the maximum integer values of a, b and c in Formula I. For example, when Ar contains a single aromatic nucleus, b and c can be each independently 1 to 3 and a can be 0 or 1, 2 or 3. When Ar contains 2 aromatic nuclei, b and c can each be an integer of 1 to 6, that is, up to three times the number of aromatic nuclei present (in naphthalene, 2). With a trinuclear Ar moiety, b and c can each be an integer of 1 to 9. For example, when Ar is a triphenyl moiety, b and c can each independently be an integer of 1 to 9. In each instance a can be zero or an integer such as b or c though it need not equal b or c. The values of a, b and c are obviously limited by the fact that their sum cannot exceed the total unsatisfied valences of Ar.

The single ring aromatic nucleus which can be the Ar moiety can be represented by the general formula $$ar(Q)_m \qquad \text{Formula II}$$

wherein ar represents a single ring aromatic nucleus (e.g., benzene, pyridine or thiophene) of 4 to 6 carbons, each Opt is as described above and m is 0 to 3.

Specific examples of such single ring Ar moieties include the following:

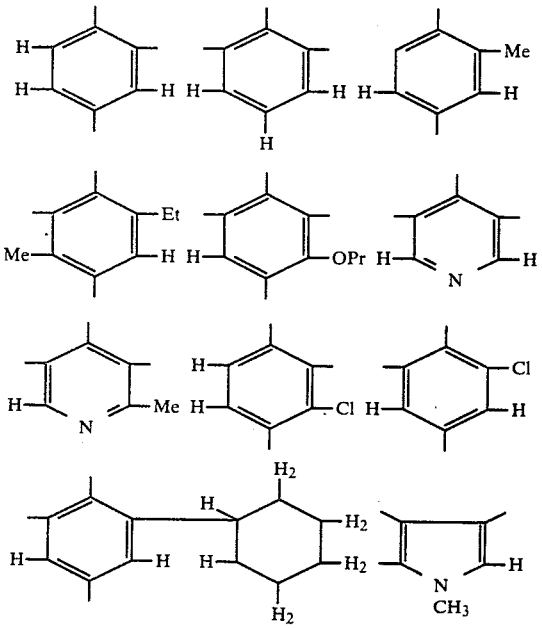

etc., wherein Me is methyl, Et is ethyl and Pr is n-propyl.

When Ar is a polynuclear fused-ring aromatic moiety, it can be represented by the general formula

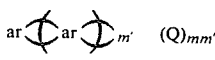

$$(Q)_{mm'} \qquad \text{Formula III}$$

wherein ar, Q and m are as defined hereinabove, m' is 1 to 4 and ⌒ represent a pair of fusing bonds fusing two rings so as to make two carbon atoms part of the rings of each of two adjacent rings. Specific examples of fused-ring aromatic moieties Ar are:

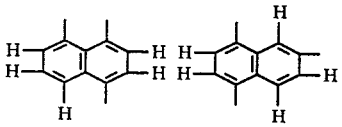

-continued

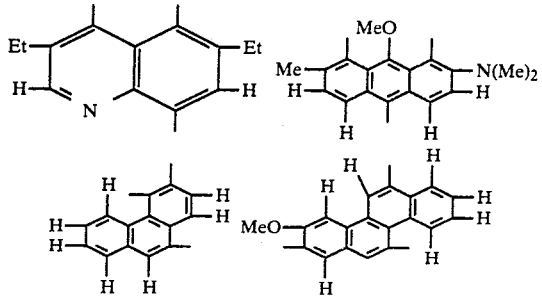

etc.

When the aromatic moiety Ar is a linked polynuclear aromatic moiety it can be represented by the general formula $$ar\text{-}(Lng\text{-}ar)_w(Q)_{mw} \qquad \text{Formula IV}$$

wherein w is an integer of 1 to about 20, ar is as described above with the proviso that there are at least 2 unsatisfied (i.e., free) valences in the total of ar groups, Q and m are as defined hereinbefore, and each Lng is a bridging linkage individually chosen from the group consisting of carbon-to-carbon single bonds, monoether linkages (i.e., —O—), keto linkages (e.g., $$-\overset{O}{\overset{\|}{C}}-),$$

monosulfide linkages (i.e., —S—), polysulfide linkages of 2 to 6 sulfur atoms (e.g., $-S_{2-6}-$), sulfinyl linkages (e.g., —S(O)—), sulfonyl linkages (e.g., $-S(O)_2$), alkylene linkages (e.g., $-CH_2-$, $-CH_2-CH_2-$, $$-CH-\underset{L}{\underset{|}{CH}}-,$$

etc.), alkylidene linkages (e.g., $-CL_2-$), alkylene ether linkages (e.g., $-CH_2O-$, $-CH_2O-CH_2-$, $-CH_2-CH_2O-$, $-CH_2CH_2-OCH_2CH_2-$, $$-\underset{L}{\underset{|}{CH_2}}\underset{L}{\underset{|}{CHOCH_2}}\underset{L}{\underset{|}{CH}}-,\ -\underset{L}{\underset{|}{CH_2}}\underset{L}{\underset{|}{CHOCH}}CH_2-,$$

etc.), alkylene keto linkages (e.g., $$-CH_2\overset{O}{\overset{\|}{C}},\ -CH_2\overset{O}{\overset{\|}{C}}CH_2-),$$

alkylene sulfide linkages (e.g., wherein one or more —O—'s in the alkylene ether linkages is replaced with an —S— atom), alkylene polysulfide linkages (e.g., wherein one or more —O—'s is replaced with a $-S_{2-6}-$ group), amino linkages (e.g., —N—, $-CH_2N-$, $-CH_2NCH_2-$, —alk—N—, where alk is alkylene, etc.), and polyamine linkages (e.g., $-N(alk-N)_{1-10}$, where the unsatisfied N atom valences are taken up with H atoms or L groups), and each L is a lower alkyl group of 1 to 7 carbon atoms.

Specific examples of Ar when it is a linked polynuclear aromatic moiety include:

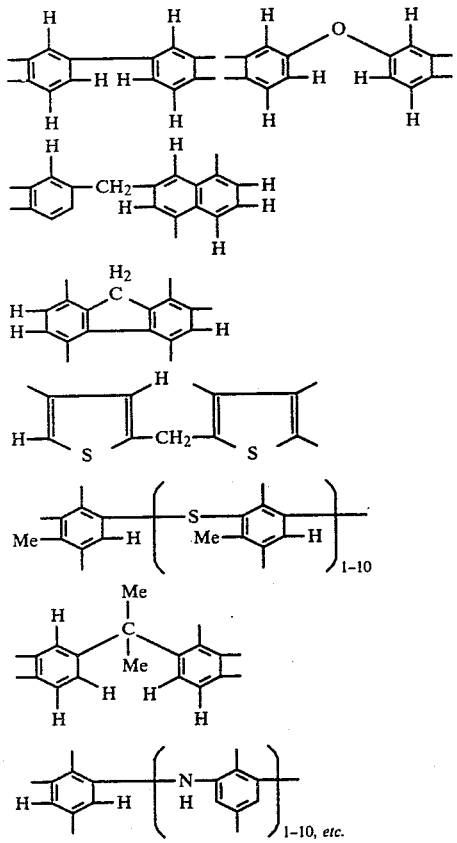

Usually all these Ar moieties are unsubstituted except for the necessary —OH and —$NO_2$ groups and the often present R groups.

In many instances the Ar moieties are of the class Ar* which consists of single ring aromatic moieties (e.g., benzene, toluene, thiophene, pyridine, etc.) and fused ring moieties (e.g., naphthalene, phenanthrene, azanaphthalene, etc.). All the foregoing disclosures relating to single and fused ring moieties within the class Ar apply equally to the class Ar*. Only the afore-described linked ring moieties are not part of the class Ar*.

Often, when the aromatic moiety is Ar or Ar*, a, b and c are 1 and there are zero optional substituents.

For such reasons as cost, availability, performance, etc., the Ar moiety is normally a benzene nucleus, lower alkylene bridged benzene nucleus, or a naphthalene nucleus. Thus, a typical Ar moiety is a benzene or naphthalene nucleus having 3 to 5 unsatisfied valences, so that one or two of said valences may be satisfied by a hydroxyl group with the remaining unsatisfied valences typically being either ortho or para to a hydroxyl group. Usually Ar is a benzene nucleus having 3 to 4 unsatisfied valences so that one can be satisfied by a hydroxyl group with the remaining 2 or 3 being either ortho or para to the hydroxyl group and satisfied by —$NO_2$ and R groups.

The Substituent R

Many of the nitrophenols used to make the nitrogen-containing compositions of this invention contain a substituent R directly bonded to the aromatic moiety Ar. In some embodiments, however, where a is zero, this R substituent is not present.

The substituent R is a substantially hydrocarbyl group. It can be a relatively simple hydrocarbyl group such as alkyl (e.g., methyl, ethyl, propyl, butyl, pentyl, hexyl, heptyl, octyl) and can be straight-chained or branched. It can be non-alkyl such as alkenyl (e.g., decenyl) or acetylenic (e.g., propargyl), etc.

The substitutent R is also substantially saturated. Such substantially saturated groups have no more than one olefinic or acetylenic linkage for every ten carbon-to-carbon linkages present.

The substituent R is nonaromatic. This means that if an aromatic (e.g., benzene) group is present, the number of nonaromatic carbon atoms present is sufficient to make the substituent exhibit substantially nonaromatic character. Quantatively, this means there are no more than 6 aromatic carbon atoms (e.g., 1 benzene ring) for every 10 nonaromatic (e.g., aliphatic and/or alicyclic) carbon atoms. Usually there are less than 6 carbon atoms for every 20 carbon atoms. Often there are no aromatic carbon atoms in the substituent R, and R then can be said to be totally nonaromatic in character.

The substituent R is bonded directly through a carbon-to-carbon bond to an aromatic carbon atom of Ar or Ar* with no intervening atoms linking R and Ar or Ar*. Typically, R substituents have an average of up to about 750 aliphatic carbon atoms, often an average of about 10 to about 400 carbon atoms and are usually alkyl or alkenyl groups. Suitable R groups have an average of at least about 30, often at least about 50, carbon atoms and are made from homopolymerized or interpolymerized $C_{2-10}$ mono- and diolefins such as ethylene, propylene, 1 and 2-butene, isobutene, butadiene, piperylene, etc. Such groups usually have a maximum average of about 500, often about 300, carbon atoms.

Usually the substituent R is purely hydrocarbyl in nature. In its broadest embodiment, however, R is described as substantially hydrocarbyl in nature. Such groups can be purely hydrocarbyl or they can contain, in addition to carbon and hydrogen, up to 10 weight percent of other elements such as oxygen (usually in the form of ether or hydroxyl groups), sulfur (usually in the form of sulfide or thiol groups), and halogen (particularly chlorine and bromine). It is essential, however, that the substantially hydrocarbyl groups, if they are not purely hydrocarbyl, not contain any non-hydrocarbyl substituent which substantially affects in a detrimental manner the hydrocarbyl properties of the substituent relevant to its performance and use as described herein. For example, it is obvious that a purely hydrocarbyl alkyl substituent of about 50 carbon atoms, and a similar substituent of about 52 carbon atoms including 2 methoxyl or methylmercapto (i.e., $CH_3S$—) groups would not differ substantially in the properties relevant to their use in the present invention and would, in fact, be considered by those of skill in the art to be equivalent.

Preferably the group R is purely hydrocarbyl and contains no non-hydrocarbyl groups. Preferably R contains no olefinic or acetylenic bonds.

Typical R groups are made from homo- or interpolymers (e.g., copolymers, terpolymers, etc.) of 1-monoolefins. Preferred sources of the R groups are ethylene/propylene copolymers, poly(propene)s and poly(butene)s. Such polymers are well known to the art. For example, poly(butene)s are obtained by, for example, polymerization of a $C_4$ refinery stream having a total butene content of 30 to 75 weight percent and an isobutene content of 20 to 60 weight percent in the presence of a Lewis acid catalyst such as aluminum chloride or boron trifluoride. These poly(butene)s contain predominantly (i.e., greater than 80% of the total repeat units) isobutene repeat units of the configuration

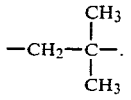

The direct attachment of the substituent R to the aromatic moiety Ar or Ar* of the nitro phenols used in this invention can be accomplished by a number of techniques well known to skilled workers in the art. A particularly suitable technique is the Friedel-Crafts reaction, wherein an olefin (e.g., a polymer containing an olefinic bond), or halogenated or hydrohalogenated analog thereof, is reacted with a phenol. The reaction occurs in the presence of a Lewis acid catalyst (e.g., boron trifluoride and its complexes with ethers, phenols, hydrogen fluoride, etc.; aluminum chloride, aluminum bromide, zinc dichloride, etc.). Methods and conditions for carrying out these reactions are well known; see, for example, the discussion in the article entitled, "Alkylation of Phenols" in Kirk-Othmer Encyclopedia of Chemical Technology, Second Edition, Vol. 1, pages 894–895, Interscience Publishers, a division of John Wiley and Company, N.Y., 1963. Other equally appropriate and convenient techniques for attaching the aliphatic R substituent to the aromatic moiety Ar will occur readily to those skilled in the art.

As will be appreciated from inspection of Formula I, the nitro phenols used in this invention contain at least one of each of the following groups or substituents: a hydroxyl group and a nitro group, $—NO_2$. Usually, but not always, an R group is present. Sometimes, as noted above, certain optional substituents, Opt, are also present. Each of the foregoing groups or substituents must be attached to a carbon atom which is a part of an aromatic nucleus in the Ar moiety. They need not, however, each be attached to the same aromatic ring if more than one aromatic nucleus is present in the Ar moiety.

In a preferred embodiment, the nitro phenols used in this invention contain a single aromatic ring, most preferably a benzene ring. This preferred class of nitro phenols can be represented by the formula

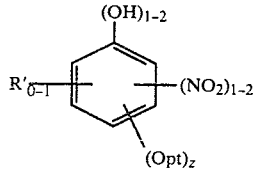

Formula V wherein R′ is a substituent within the afore-described genus of R having an average of up to about 750 aliphatic carbon atoms and z is zero or 1. Typically, R′ is an alkyl or alkenyl group having an average of about 10 to about 300 carbon atoms. Often R′ is located ortho or para to a hydroxyl group. Since the substituent R′ is within the genus of R the discussion of the character of R applies equally to R′. Typically, R′ is a purely hydrocarbyl alkyl or alkenyl substituent and z is 0.

In a particular preferred embodiment of this invention, the nitro phenol used can be represented by the formula

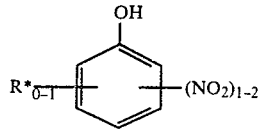

Formula VI wherein R* is a hydrocarbyl alkyl or alkenyl group having an average of up to about 750 carbon atoms. Typically R* is derived from homopolymerized or interpolymerized $C_2$—$C_{10}$ 1-olefins and is located para to an —OH group and has an average of from about 50 to about 500 carbon atoms.

Usually R* is derived from polymerized ethylene, propylene, butylene and mixtures thereof. Typically, it is derived from polymerized propylene or butylenes. In one embodiment, only one nitro group is present and it is ortho to the —OH group while R* is ortho or para to the —OH group. In another embodiment, two nitro groups are present and are located in either both ortho or an ortho and para position while R* is located in the other ortho or the para position.

The nitro phenols used in this invention can be prepared by a number of known synthetic routes. These routes can vary in the type reactions used and the sequence in which they are employed. For example, an aromatic hydrocarbon, such as benzene, can be alkylated with alkylating agent such as a polymeric olefin to form an alkylated aromatic intermediate. This intermediate can then be nitrated, for example, to form polynitro intermediate and one of the nitro groups in this intermediate converted to a hydroxyl group through fusion with caustic to provide the desired nitro phenol.

Another useful route to the nitro phenols used in this invention involves the alkylation of a phenol with an olefinic alkylating agent to form an alkylated phenol. This alkylated phenol can then be nitrated to form a nitro phenol.

Techniques for alkylating phenols are well known to those skilled in the art as the above-noted article in Kirk-Othmer Encyclopedia of Chemical Technology demonstrates. Techniques for nitrating phenols are also well known. See, for example, in Kirk-Othmer Encyclopedia of Chemical Technology, Second Edition, Vol. 13, the article entitled "Nitrophenols", page 888 et seq., as well as the treatises "Aromatic Substitution; Nitration and Halogenation" by P. B. D. De La Mare and J. H. Ridd, N.Y., Academic Press, 1959; "Nitration and Aromatic Reactivity" by J. G. Hogget, London, Cambridge University Press, 1961; and "The Chemistry of the Nitro and Nitroso Groups", Henry Feuer, Editor, Interscience Publishers, N.Y., 1969.

Aromatic hydroxy compounds can be nitrated with nitric acid, mixtures of nitric acid with acids such as sulfuric acid or boron trifluoride, $NO_2$, $N_2O_3$, $N_2O_4$, $N_2O_5$, $NO_2Cl$, $NO_2Br$, mixtures of alkali and alkaline earth metal nitrates with mineral acids (e.g., $H_2SO_4$), alkanoyl nitrates (e.g., acetyl nitrate) and mixtures of two or more of these nitrating agents. Generally nitric acid of a concentration of, for example, about 30–90% is a convenient nitrating reagent. Substantially inert liquid diluents such as acetic or butyric acid or saturated aliphatic hydrocarbons can aid in carrying out the reaction by improving reagent contact and heat transfer properties.

Conditions and procedures for nitrating hydroxy aromatic compounds are well known in the art. For example, the reaction can be carried out at temperatures of about −15° C. to about 150° C. Usually nitration of alkyl phenols is conveniently carried out between about 25°–75° C.

Generally, depending on the particular nitrating agent, about 0.5–4 moles of nitrating agent is used for every mole of aromatic nucleus present in the hydroxy aromatic intermediate to be nitrated. If more than one aromatic nucleus is present in the Ar moiety, the amount of nitrating agent can be increased proportionately according to the number of such nuclei present. For example, a mole of naphthalene-based aromatic intermediate has, for purposes of this disclosure, the equivalent of two "single ring" aromatic nuclei so that about 1–4 moles of nitrating agent would generally be used. When nitric acid is used as a nitrating agent usually about 1.0 to about 3.0 moles per mole of aromatic nucleus is used. Up to about a 5-molar excess of nitrating agent (per "single ring" aromatic nucleus) may be used when it is desired to drive the reaction forward or carry it out rapidly.

Nitration of a phenol generally takes 0.25 to 24 hours, though it may be convenient to react the nitration mixture for longer periods, such as 96 hours.

The typical route to the nitro phenols used in this invention just described can be summarized as nitrating with at least one nitrating agent at least one phenol represented by the formula

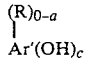

Formula VII wherein each R is an aliphatic substitutent of at least about 30, typically about 30 to about 700, carbon atoms; at least one R is in a position ortho or para to at least one —OH substituent attached directly to Ar'; a and c are each independently integers of one up to three times the number of aromatic nuclei in Ar', their sum not exceeding the number of unsatisfied valences in Ar', and Ar' is an aromtic moiety having at least one hydrogen bonded to a carbon of an aromatic ring and 0 to 3 optional substituents as described above with reference to Opt. In other respects Ar' is the same as Ar and the description of the latter given hereinabove applies equally to Ar'. Usually Ar' is a benzene nucleus and R has an average of about 50 to about 500 carbons and typically is derived from homopolymerized or interpolymerized $C_{2-10}$ olefins and mixtures thereof.

Typically the Ar' moieties are of the Ar'' type which consists of single ring aromatic moieties (e.g., benzene, toluene, thiophene, pyridine, etc.) and fused ring moieties (e.g., naphthalene, phenanthrene, azanaphthalene, etc.). All the foregoing preferences and discussion of Ar' apply where appropriate to the Ar'' moieties.

Typically, such nitrated phenols are made by nitrating with a nitrating agent at least one compound of the formula

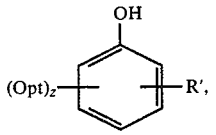

Formula VIII wherein R' and Opt are as described hereinabove and R' is usually located in a position ortho or para to the hydroxyl group; and z is 0 or 1. Typically R' is para to the hydroxyl group and z is 0.

Certain nitro phenols used in this invention having linked aromatic nuclei can be made by several alternative synthetic sequences. For example, a hydrocarbon-substituted phenolic compound such as those described hereinabove can be first reacted with a linking reagent such as an aldehyde or ketone (e.g., formaldehyde) to form a linked product having, for example, methylene linkages between aromatic nuclei. These linked intermediates can then be nitrated by the procedures described hereinabove to give the desired linked nitro phenol. Such a sequence can be illustrated by the following sequence:

Formula IX

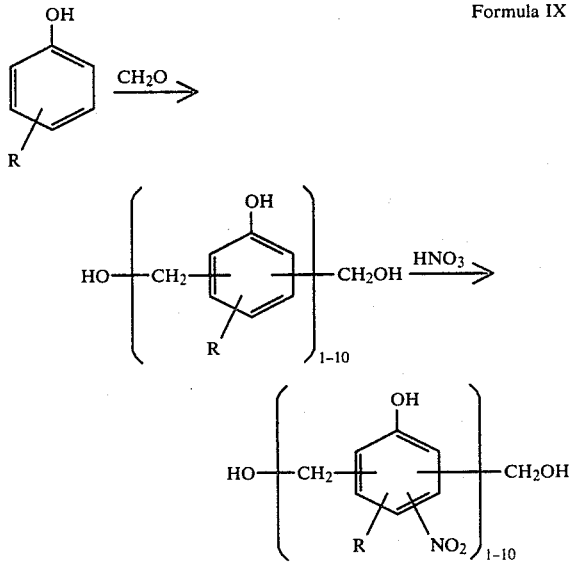

Alternatively, a single ring nitro phenol can be linked using a sulfur monochloride or dichloride to yield a sulfur-linked nitro phenol. This sequence can be illustrated by the following sequence:

Formula X

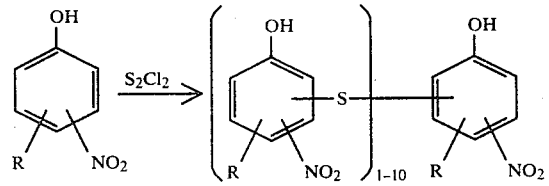

Still another route to linked nitro phenols used in this invention having linked aromatic nuclei is through the condensation of a hydrocarbon-substituted phenol and a nitrophenol which can or cannot be hydrocarbon-substituted with the aid of a linking agent such as sulfur, formaldehyde, etc. This sequence can be illustrated by the sequence:

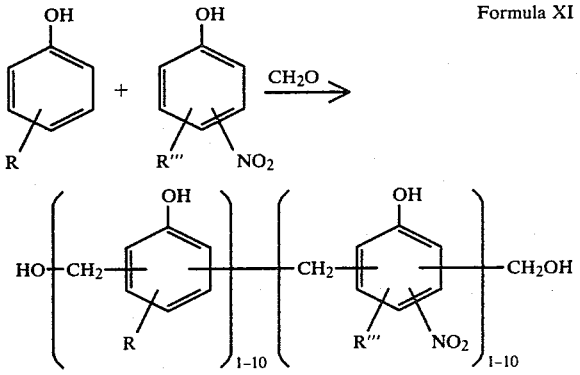

Formula XI

R and R''' in Formulae IX–XI are as described hereinabove.

(B) The amino compound

The nitrogen-containing compositions of this invention are made by condensing the hereinbefore-described nitro phenols with at least one (i.e., one or more) amino compound having at least one hydrogen atom directly bonded to a nitrogen atom or an oxygen atom. Typically, this compound is an amine and thus includes primary, secondary and, in certain instances as described below, tertiary amines. However, when they are tertiary monoamines, it is clear that they also must contain at least one hydroxyl group (i.e., a hydrogen directly bonded to a oxygen atom). These amines can be mono amines or polyamines. When they are the latter, they may contain one or more tertiary amine groups as long as there is present at least one primary ($-NH_2$) or secondary amine $$(-\underset{|}{N}-H)$$

or hydroxyl (—OH) group. The amines may be aliphatic, aromatic, carbocyclic or heterocyclic. Amines containing at least one primary or secondary amino group are preferred.

Monoamines can be used in the method of this invention, especially primary or secondary monoamines and, particularly those having substantially hydrocarbyl radicals that are free from acetylenic unsaturation and contain about 1–30, usually about 1–10, carbon atoms, and no more than 1 carbon-to-carbon double bond per radical. Monoamines containing purely hydrocarbyl alkyl radicals with no unsaturation are typical.

Among the monoamines useful in this invention are aliphatic monoamines such as those of the general formula $HNR^1R^2$, wherein $R^1$ is an alkyl or alkenyl radical preferably containing up to about 20 carbon atoms and $R^2$ is hydrogen or an alkyl or alkenyl radical preferably containing up to about 20 carbon atoms. Another useful class of monoamines are aromatic monoamines such as those of the general formula $HNR^3R^4$, wherein $R^3$ is a phenyl, alkylated phenyl, naphthyl or alkylated naphthyl radical of up to about 20 carbon atoms (or analogous radicals having one or more optional substituents $R^1$ discussed hereinabove) and $R^4$ is a hydrogen atom, $R^1$ or $R^3$. Representative examples of these two classes of monoamines are ethylamine, diethylamine, n-butylamine, di-n-butylamine, allylamine, isobutylamine, cocoamine, stearylamine, laurylamine, methyllaurylamine, oleylamine, aniline, methylaniline, N-methylaniline, diphenylamine, benzylamine, tolylamine and methyl-2-cyclohexylamine.

Hydroxy amines are also included in the class of useful monoamines. Such amines are the hydroxyhydrocarbyl-substituted analogs of the afore-described monoamines. Particular hydroxy monoamines have the formulae $HNR^5R^6$ and $HNR^7R^8$, wherein $R^5$ is an alkyl, alkenyl or hydroxy-substituted alkyl or alkenyl radical of up to about 20 carbon atoms; $R^6$ is a hydrogen atom or $R^5$; $R^7$ is a hydroxy-substituted phenyl, alkylated phenyl, naphthyl or alkylated naphthyl radical (or analogous radicals having one or more optional substituents $R^1$ discussed hereinabove) of up to about 20 carbon atoms and $R^8$ is a hydrogen atom, alkyl of up to about 20 carbon atoms, hydroxy-substituted alkyl of up to about 20 carbon atoms, or $R^7$, at least one of $R^5$ and $R^6$ and at least one of $R^7$ and $R^8$ being hydroxy-substituted.

Suitable hydroxy-substituted monoamines include ethanolamine, di(3-propanol)amine, 4-hydroxybutylamine, diethanolamine, N-methyl-2-propylamine, 3-hydroxyaniline, N-hydroxyethylethylene diamine, N,N-di(hydroxypropyl)propylene diamine, tris(hydroxymethyl)methylamine, etc. While in general, hydroxy amines containing only one hydroxy group will be employed as reactants, those containing more (e.g., di- and triethanolamine) can also be used.

Heterocyclic amines are also useful in the method of this invention if they have one or more NH and/or —OH groups, particularly those that contain primary or secondary amino groups. The heterocyclic ring can incorporate unsaturation and can be substituted with hydrocarbon radicals such as alkyl, alkenyl, aryl, alkaryl or aralkyl. In addition, the ring can contain other hetero atoms such as oxygen, sulfur or other nitrogen atoms, including those not having hydrogen atoms bonded to them. Generally, these rings have 3–10, preferably 5 or 6, ring members. Among such heterocycles are aziridines, azetidines, azolidines, pyridines, pyrroles, piperidines, imidazoles, indoles, piperazines, isoindoles, purines, morpholines, thiamorpholines, N-aminoalkyl morpholines, N-aminoalkyl thiamorpholines, azepines, azocines, azonines, azecines and tetrahydro-, dihydro-, and perhydro-derivatives of each of the above. Generally, the heterocyclic amines will contain not more than about thirty carbon atoms and usually not more than about 20 carbon atoms. Preferred heterocyclic amines are the saturated ones with 5- and 6-membered rings, especially the piperidines, piperazines and morpholines, such as piperazine, N-ethylpiperazine, and N-hydroxypropyl morpholine.

Another useful class of hydroxyl containing monoamines is represented by the formula $$(R^{12})_3N \qquad \text{Formula XII}$$

wherein each $R^{12}$ is independently a hydrogen atom, $R^4$ or a mono- or di-hydroxy substituted hydrocarbyl group of 1 to 20 carbon atoms, with the proviso that at least one of $R^{12}$ is hydroxyl or di-hydroxyl substituted.

Polyamines, particularly aliphatic polyamines, analogous in general to the aforementioned monoamines, are useful for making the nitrogen-containing compositions of this invention. Among the polyamines are alkylene polyamines (and mixtures thereof) including those represented by the formula Formula XIII wherein n is an integer of 1 to about 10, $R^{10}$ is a divalent hydrocarbyl group of 1 to about 10 carbon atoms and each $R^9$ is independently a hydrogen atom, a lower hydrocarbyl group of 1 to 7 carbon atoms or lower hydroxyl-substituted hydrocarbyl group of 1 to 7 carbon atoms with the proviso that when none of the $R^9$ groups is a hydroxyl-substituted hydrocarbyl group, at least one of the $R^9$ groups is a hydrogen atom.

Preferably $R^{10}$ is an aliphatic radical of up to about 10 carbon atoms which may be substituted with one or two hydroxy groups, and $R^{10}$ is a lower alkylene radical having 1–10, preferably 2–6, carbon atoms. Especially preferred are the alkylene polyamines wherein each $R^9$ is hydrogen. Such alkylene polyamines include methylene polyamines, ethylene polyamines, propylene polyamines, butylene polyamines, pentylene polyamines, hexylene polyamines, heptylene polyamines, etc. The higher homologs of such amines and related aminoalkyl-substituted piperazine are also included. Specific examples of such polyamines include ethylene diamine, triethylene tetramine, tris(2-aminoethyl)amine, propylene diamine, trimethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, 2-heptyl-3-(2-aminopropyl)imidazoline, 1,3-bis(2-aminoethyl)imidazolidine, 1-(2-aminopropyl)piperazine, 1,4-bis(2-aminoethyl)piperazine and 2-methyl-1-(2-aminobutyl)piperazine. Higher homologs, obtained by condensing two or more of the above-illustrated alkylene amines, are also useful.

The ethylene polyamines, examples of which are mentioned above, are especially useful for reasons of availability, cost and effectiveness. Such polyamines are described in detail under the heading "Diamines and Higher Amines" in Kirk-Othmer, Encyclopedia of Chemical Technology, Second Edition, Vol. 7, pp. 22–39. They are prepared most conveniently by the reaction of an alkylene chloride with ammonia or by reaction of an ethylene imine with ammonia. These reactions result in the production of somewhat complex mixtures of alkylene polyamines, including cyclic condensation products such as piperazines. Because of their availability, these mixtures are particularly useful in the method of this invention. Satisfactory products can also be obtained by the use of pure alkylene polyamines.

Hydroxy polyamines, e.g., alkylene polyamines having one or more hydroxyalkyl substituents on the nitrogen atoms, are also useful in preparing amides of this invention. Preferred hydroxyalkyl-substituted alkylene polyamines are those in which the hydroxyalkyl group has less than about 10 carbon atoms. Examples of such hydroxyalkyl-substituted polyamines include N-(2-hydroxyethyl)ethylene diamine, N,N'-bis(2-hydroxyethyl)ethylene diamine, 1-(2-hydroxyethyl)piperazine, monohydroxypropyltetraethylene pentamine and N-(3-hydroxybutyl)tetramethylene diamine. Higher homologs obtained by condensation of the above-illustrated hydroxyalkyl-substituted alkylene amines through amino radicals or through hydroxyl radicals are likewise useful. Generally these hydroxy polyamines are produced by reaction of an epoxide such as ethylene oxide or propylene oxide with the afore-described polyamines or mixtures thereof.

THE CONDENSATION OF (A) AND (B)

To make the nitrogen-containing compositions of the present invention, at least one (i.e., one or a mixture of two or more) nitro phenol is condensed with at least one of the afore-described amines. This condensation is carried until the resulting nitrogen-containing composition is substantially free (i.e., contains no more than about 30% of the original amount) of nitro groups. This point can be determined by any convenient means such as infrared spectroscopy, polarimetry, elemental analysis, nuclear magnetic resonance, ultraviolet spectroscopy, chromatography, etc. It is presently believed that the condensation involves a reaction between a nitro group of the phenol and one or more of the >NH or —OH groups of the amine. This is based on the observation that the characteristic nitro absorption bands in the infrared spectrum of the reaction mixture disappear as it proceeds. For this reason, among others, it is believed that the condensation products of this invention are best described in terms of the method by which they are made.

The condensation of nitrophenol and amine is generally carried out at a temperature of about 25° C. up to decomposition temperature of the reaction mixture or some component of it. Generally this temperature is below about 250° C. Typically, the condensation reaction is carried out at a temperature in the range of about 50°–175° C.

When the nitro phenol contains less than about 15 carbon atoms per nitro group per molecule it is desirable to conduct the initial part of the condensation at lower temperatures (e.g., 0° C. to 50° C.) and with care since violent reaction is possible. Means well known to skilled workers such as pressure vents, barracades, large amounts of inert solvent/diluents, provisions for rapid cooling and so forth should be employed when working with these lower molecular weight nitro phenols in the initial phases of the reaction. As the reaction proceeds it is possible and sometimes desirable to carefully increase the reaction temperature.

Generally at least a half of an equivalent of nitro compound is used for each equivalent of aminonitrogen compound. Usually, it is not advantageous to use more than three equivalents of nitro compound per equivalent of amine or eight equivalents of amine per equivalent of nitro compound. An equivalent of nitro compound is determined by measuring the nitro phenol's molecular weight and dividing it by the number of nitro groups believed to be present in each molecule. Thus a nitro phenol having but one nitro group has an equivalent weight equal to its molecular weight while a nitro phenol having two nitro groups per molecule has an equivalent weight equal to half of its molecular weight.

An equivalent of amine is determined by dividing the amine's molecular weight by the number of primary ($NH_2$—) and secondary

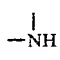

(that is reactive nitrogen) groups present in the molecule. If no such primary amine groups are present, equivalent weight is determined by dividing the molecular weight by the number of secondary amine (>NH) groups present in the molecule. If no primary or secondary nitrogen amine groups are present, the equivalent of amine is calculated by dividing the amine's molecular weight by the number of hydroxyl groups present in the molecule.

In a typical embodiment, the total amounts of (A) and (B) employed in the condensation are in the ratio of about 0.5–10 equivalents of (B) per mole of (A), often about 1.0–5 equivalents of (B) per mole of (A).

While it is not essential, it is usually preferable to carry out the condensation of nitro phenol and amine in the presence of a substantially inert, normally liquid solvent/diluent which increases the fluidity of the reaction mixture, optimizes heat transfer and improves contact of the reactants. Such substantially inert, normally liquid solvent/diluents as are described hereinbelow with reference to additive concentrates are useful in this regard. A typical such solvent/diluent is mineral oil.

As stated hereinabove, condensation reaction is carried out until the mixture is substantially free of nitro groups as measured by such standard chemical analysis techniques such as mentioned above. Generally this will involve a reaction period of about 1–96 hours although longer reaction periods may be used. The nitrogen-containing condensation product can be recovered or separated by standard techniques well known to the arts such as distillation, filtration, precipitation, and so forth. Often, however, it is not necessary to effect separation procedures and the reaction mixture may be used directly as a dispersion or solution in formulating the lubricant, fuel and additive concentrates hereinbelow described.

The following examples demonstrate the practice of the present invention in some of its various aspects and include what is presently believed to be the best mode of practicing the invention. All parts and percentages in the examples and elsewhere in the specification and claims are by weight and, likewise, all temperatures are in degrees Celsius, unless expressly stated to the contrary.

EXAMPLE 1(A)

An alkylated phenol is prepared by reacting phenol with a polybutene having a number average molecular weight of approximately 1000 (Vapor Phase Osmometry) in the presence of a boron trifluoride-phenol complex catalyst. Stripping of the product thus formed, first to 230°/760 torr (vapor temperature) and then 205°/50 torr (vapor temperature) provides polybutene-substituted phenol.

EXAMPLE 1(B)

A mixture of 4578 parts of the polybutene-substituted phenol, 3052 parts of diluent mineral oil and 725 parts of textile spirits is heated with agitation to 60° to achieve homogenity. After cooling to 30°, a mixture of 319.5 parts of 16-molar nitric acid and 600 parts of water is slowly added into the mixture which is kept below 40° by external cooling. After stirring the mixture for an additional two hours, 3710 parts is transferred to a second reaction vessel. The remaining material is stripped to 150°/43 torr (vapor temperature), cooled to 110° and filtered through diatomaceous earth to provide as a filtrate the desired nitro phenol. This material has a nitrogen content of 0.58%.

EXAMPLE 1(C)

To 1353 parts of the nitro phenol described in Example 1(A) under nitrogen atmosphere, at 49°, is added 61.5 parts of a commercial polyethylene polyamine mixture containing 33.5% nitrogen and substantially corresponding in emperical formula to tetraethylene pentamine. The reaction mixture thus formed is heated to 80° for 1.5 hours and then stored for 16 hours at 25°. It is then heated to 130°–160° for a total of 15 hours and finally stripped to 160°/30 torr (vapor temperature). The residue was filtered through diatomaceous earth to give the desired product as a filtrate. This product contains 1.5% nitrogen.

EXAMPLE 2

The nitro polybutene-substituted phenol and polyethylene polyamine described in Example 1 are reacted in essentially the same fashion as described in Example 1 except 1,113 parts of phenol is used with 30.75 parts polyamine. The product obtained has a nitrogen content of 1.15%.

EXAMPLE 3

A mixture of 1600 parts of a polybutene-substituted phenol prepared in essentially the same fashion as that described in Example 1(A) from a polybutene having a number average molecular weight of 1400 (Gel Permeation Chromatography), 10 parts of aqueous hydrochloric acid and 33 parts of paraformaldehyde is heated to 90° under a nitrogen atmosphere for a total of 20 hours with intermittent storage at room temperature. Five hundred parts of textile spirits is then added, followed by 91.3 parts of concentrated nitric acid in 100 parts water. During the nitric acid addition the reaction temperature was maintained at 31°–38° by external cooling. The reaction mixture is then stirred for two hours at room temperature and 61.5 parts of the polyethylene polyamine described in Example 1(C) is added slowly. The reaction mixture is heated to 160° for 7 hours and then stripped at 160°/30 torr (vapor temperature) and the residue filtered through diatomaceous earth. The filtrate is the desired product and has a nitrogen content of 0.88%.

EXAMPLE 4

To a mixture of 654 parts of the polybutene-substituted phenol described in Example 1(A) and 654 parts of isobutyric acid at 27°–31° is added 19 parts of 16 molar nitric acid over 0.5 hour, while provision is made for external cooling of the mixture. The reaction mixture is then kept at 50° for three hours and stored at room temperature for a total of 63 hours. Stripping to 160°/20 torr (vapor temperature), followed by filtration through diatomaceous earth provides the desired dinitro phenol intermediate which has a nitrogen content of 1.8%. To 200 parts of this dinitro phenol intermediate is added 24 parts of the polyethylene polyamine described in Example 1(C) while the reaction mixture is at 160°. The reaction mixture is kept at this temperature for a total of five hours. After five hours the infrared absorption bands at 6.5 and 7.6 microns (characteristic of the nitro group) disappear from the mixture's spectrum. The mixture is stripped at 160°/50 torr (vapor temperature) to provide as a residue the desired product which has a nitrogen content of 3.94%.

EXAMPLE 5(A)

To a mixture of 1596 parts of tetrapropylene-substituted phenol and 1594 parts of glacial acetic acid at 15° is slowly added 423 parts of 70% nitric acid. After storage for 72 hours at 25°, the reaction mixture was stripped to 150°/22 torr. The residue was filtered to provide the desired nitro phenol intermediate which had a nitrogen content of 3.19%.

EXAMPLE 5(B)

To 330 parts of the nitro phenol intermediate described in Example 5(A) is added 87 parts of N,N-diethyl ethylene diamine. The addition causes the reaction temperature to increase from 29° to 50°. The reaction mixture is heated with care under a nitrogen atmosphere to 160° at which point some distillation of amine is observed. The mixture is then stripped to 145°/25 torr. An infrared spectrum of the residue shows the absence of absorption bands at 6.15, 6.55, 7.6 and 8.4 microns suggesting that the $NO_2$ functionality in the starting nitro phenol intermediate is involved in the reaction. This product has a nitrogen content of 5.75%.

EXAMPLE 6

To 679 parts of an oil solution containing 40% diluent oil and 60% nitro polybutene-substituted phenol made in essentially the same fashion as that described in Example 1(B) under nitrogen at 150° is added 134 parts of triethanol amine over a 1.5 hour period. The reaction mixture is then held for 12 hours at 200°. Periodic infrared analyses show a decreasing amount of absorption at 6.5 microns believed to be characteristic of the —$NO_2$ group. The mixture is then stripped to 200°/20 torr (vapor temperature), cooled to 100° and filtered through diatomaceous earth to provide the desired product as a filtrate containing 0.97% nitrogen.

EXAMPLE 7(A)

To a mixture of 265 parts of the substituted phenol described in Example 1(A), 176 parts of blend oil and 42 parts of a petroleum naphtha is added slowly a mixture of 18.4 parts of concentrated nitric acid (69–70%) and 35 parts water. This mixture is stirred for 3 hours at about 30°–45°, stripped to 120°/20 torr and filtered to provide an oil solution of the desired nitro phenol.

EXAMPLE 7(B)

To 77.7 parts of the nitro phenol described in Example 7(A) under nitrogen at 160° is slowly added 3.59 parts of the tetraethylene pentamine described in Example 1(C) over 1.7 hours. This mixture is heated to 120°–160° for a total of 15 hours with intermittent storage at room temperature and is then stripped at 120°–124° to provide as a filtrate the desired product which contains 1.4% nitrogen.

EXAMPLE 8

To 750 parts of the polybutene-substituted nitro phenol described in Example 7(A) at 50° under nitrogen is added 11.4 parts of diethylene triamine. After being heated for a total of ten hours at 150°–160° the reaction mixture is stripped to 158°/23 torr. Filtration through diatomaceous earth at 140° provides as a filtrate the desired final product having a nitrogen content of 0.93%.

EXAMPLE 9(A)

Heptyl phenol is nitrated by treating 873 parts of phenol with a mixture of 598 parts nitric acid and 598 parts water. Provision is made for external cooling of the reaction mixture with ice water. The addition of acid is carried out over a three-hour period while the temperature of the mixture ranges between 24° and 48°. The material is stripped to 157°/30 mm to give the desired final product which exhibits a strong infrared absorption at 6.5 microns, believed to be characteristic of the $NO_2$ group. The product contains 8.32% nitrogen and is believed to be a dinitro monoheptyl phenol.

EXAMPLE 9(B)

To a mixture of 50 parts textile spirits and 112 parts of the dinitro heptyl phenol described in Example 9(A) is added 86 parts of octylamine over 1.5 hours while the temperature is held at 27°–31°. The solution is held at 75° for two hours and then heated at 100°–150° for ten hours under a nitrogen atmosphere. The mixture is stripped to 160°/24 torr and the residue filtered at 130° through diatomaceous earth to provide the desired product as the filtrate. This product contains 5.56% nitrogen.

EXAMPLE 10

To a mixture of 50 parts textile spirits and 126 parts of the dinitro heptyl phenol intermediate described in Example 9(A) is added 190.5 parts of dibutyl amine over 2.5 hours. The temperature ranges between 20° and 40° during the addition. An additional 126 parts of dinitro heptyl phenol is slowly added and then an additional 200 parts of textile spirits is added. The reaction mixture is refluxed at 75° for 1.5 hours. The temperature is slowly increased to 160° while provision is made for collecting the distilling textile spirits. Any dibutyl amine which distills is returned to the reaction mixture which is held at 130° for one hour and then 160°–170° for a total of ten hours. Filtration at 110° provides as a filtrate the desired final product which contains 8.54% nitrogen.

As previously indicated the nitrogen-containing compositions of this invention are useful as additives for lubricant compositions based on oils of lubricating viscosity. These lubricant compositions find use in various applications such as the lubrication of internal combustion engines. The additives act as detergents and dispersants for engine sludge that accumulates in the oil during its use.

Exemplary lubricant compositions of this invention include crankcase lubricating oils for compression-ignited and spark-ignited internal combustion engines such as diesel, Otto and two-cycle (two-stroke) automobile and truck engines, marine and railroad engines and the like. For the purposes of this description, Wankel engines are considered to be two-cycle engines. Automatic transmission fluids, transaxle lubricants, gear lubricants, industrial oils such as metal-working lubricants, hydraulic fluids and other oil and grease compositions can also benefit from the incorporation of the nitrogen-containing compositions of this invention.

The lubricant compositions of this invention can be based on natural oils, synthetic oils, natural oil mixtures, synthetic oil mixtures and natural oil-synthetic oil mixtures. Natural oils include animal oils and vegetable oils (e.g., caster oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils and halo-substituted hydrocarbon oils such as homopolymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide homopolymers and interpolymers and derivatives thereof where the terminal hydroxyl groups have been modified by esterification, etherification, etc., constitute another class of known synthetic lubricating oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, or the $C_3$ Oxo acid diester of tetraethylene glycol.

Another suitable class of synthetic lubricating oils comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra(p-tert-butylphenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the lubricant composition of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, secondary distillation, acid or base extraction, filtration, percolation, etc. Rerefined oils are obtained by processes, similar to those used to obtain refined oils, applied to refined oils which have been already used in service. Such rerefined oils are also known as reclaimed or reprocessed oils and often are additionally processed by techniques directed to removal of spent additives and oil breakdown products.

In general, about 0.01–20, usually about 0.1–10% (by weight) of at least one nitrogen-containing composition of this invention is dissolved or stably dispersed in oil of lubricating viscosity to produce a satisfactory lubricant. The invention also contemplates the use of other additives in combination with the composition of this invention. Such additives include, for example, auxiliary detergents and dispersants of the ash-producing or ashless type, oxidation-inhibiting agents, pour point depressing agents, extreme pressure agents, color stabilizers and anti-foam agents.

The term "stably dispersed" as used in this specification and the appended claims is intended to refer to a composition (e.g., a single additive or compound, a mixture of two or more additives or compounds, etc.) which is dispersed in a given medium to an extent which allows it to function in its intended manner. Thus, for example, where a composition of this invention is used in an oil, it is sufficient that the composition be suspended in an oil in an amount sufficient to enable the oil to possess one or more of the desired properties imparted to it by the suspended composition. Such suspension can be achieved in various conventional ways such as constantly circulating the oil or splashing it in various types of lubricating systems. Conventional dispersants (such as acylated nitrogen dispersants disclosed in U.S. Pat. No. 3,219,666) often found in lubricating oils and fuels can be used to promote the stable dispersion or suspension of the composition. In any event, the compositions of this invention are "soluble" or "stably dispersible" in the normally liquid media in which they are used in at least the minimum concentrations set forth elsewhere herein. Thus, the terminology "soluble" and "stably dispersible" is used in a conventional manner and will be understood to those of ordinary skill in the art.

As used in the specification and the appended claims, the term "substantially inert" when used to refer to solvents, diluents, base oils, and the like, is intended to mean that the solvent, diluent, etc., is inert to chemical or physical change under the conditions in which it is used so as not to materially interfere in an adverse manner with the preparation, storage, blending and/or functioning of the nitrogen-containing compositions, oils, fuels, or concentrates of this invention in the context of their intended use. For example, small amounts of a solvent, diluent, etc. can undergo minimal reaction or degradation without preventing the making and using of the invention as described herein. In other words, such reaction or degradation, while technically discernible, would not be sufficient to deter the practical worker of ordinary skill in the art from making and using the invention for its intended purposes. "Substantially inert" as used herein is, thus, readily understood and appreciated by those of ordinary skill in the art.

The nitrogen-containing compositions of this invention can also be used in fuels where they function, for example, as carburetor detergents. Fuel compositions of this invention usually contain a major portion of a normally liquid fuel such as hydrocarbonaceous petroleum distillate fuel (e.g., motor gasoline as defined by ASTM Specification D-439-73 and diesel fuel or fuel oil as defined by ASTM Specification D-396). Normally liquid fuel compositions comprising non-hydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale, and coal. Normally liquid fuels which are mixtures of one or more hydrocarbonaceous fuel and one or more non-hydrocarbonaceous material are also contemplated. Examples of such mixtures are combinations of gasoline and ethanol, diesel fuel and ether, gasoline and nitromethane, etc. Particularly preferred is gasoline, that is, a mixture of hydrocarbons having an ASTM boiling point of 60° C. at the 10% distillation point to about 205° C. at the 90% distillation point.

Generally, these fuel compositions contain an amount of at least one nitrogen-containing composition of this invention sufficient to impart dispersant, detergent or demulsifying properties to the fuel; usually this amount is about 0.00001 to about 10%; typically about 0.0001 to about 5%, by weight of the nitrogen-containing composition. Preferred are gasoline-based fuel compositions which exhibit engine sludge dispersancy and detergency and carburetor detergency properties.

The fuel compositions of this invention can obtain, in addition to the compositions of this invention, other additives which are well known to those of skill in the art. These can include anti-knock agents such as tetraalkyl lead compounds, manganese and nickel octane improvers, lead scavengers such as halo-alkanes (e.g., ethylene dichloride and ethylene dibromide), deposit preventors or modifiers such as triaryl phosphates, dyes, centane improvers, anti-oxidants such as 2,6-di-tertiary-butyl-4-methylphenol, rust inhibitors, such as alkylated succinic acids and anhydrides, bacteriostatic agents, gum inhibitors, metal deactivators, demulsifiers, anti-icing agents and the like. Refined mineral oils, especially bright stocks, and oily homo- and interpolymerized lower olefins such as ethylene/propylene copolymers, polypropylene and polybutenes, etc. are often used in fuel compositions (especially gasolines) to reduce deposit formation in the induction systems of engines using such fuels.

In certain lubricant and/or fuel compositions of the present invention, the afore-described compositions of this invention are combined with other ashless dispersants in gasoline. Such ashless dispersants are preferably esters of a mono- or polyol and a high molecular weight mono- or polycarboxylic acid acylating agent containing at least 30 carbon atoms in the acyl moiety. Such esters are well known to those of skill in the art. See, for example, French Pat. No. 1,396,654; British Pat. Nos. 981,950 and 1,055,337; and U.S. Pat. Nos. 3,255,108; 3,311,558; 3,331,776; 3,346,354; 3,522,179; 3,579,450; 3,452,680; 3,381,022; 3,639,242; 3,697,428; 3,708,522; and British Patent Specification No. 1,306,529. These patents are expressly incorporated herein by reference for their disclosure of suitable esters and methods for their preparation. In another preferred embodiment the nitrogen-containing compositions of this invention are used in conjunction with a borated alkyl succinic acid/-polyamine dispersants/detergents. Such borated materials are known to the art; see, for example, U.s. Pat. No. 3,087,936 which is hereby incorporated by reference for its disclosure of borated materials. Generally, the weight ratio of the compositions of this invention to the aforesaid dispersants is about 0.1 to about 10.0; preferably about 1 to about 10 parts of composition of this invention to 1 part dispersant.

In still other embodiments of this invention, the inventive nitrogen-containing compositions can be combined with Mannich condensation products formed from substituted phenols, aldehydes, polyamines, and amino pyridines to make lubricants and/or fuel additives. Such condensation products are described in U.S. Pat. No. 3,649,659; 3,558,743; 3,539,633; 3,704,308; and 3,724,277.

When the nitro phenols used in this invention do not have a hydrocarbyl substituent R (i.e., a in Formula I is zero), the resulting condensation products are useful as intermediates for making lubricant and fuel additives. For example, they can be acylated with succinic acids having a hydrocarbyl substituent of at least about 30 carbon atoms or reacted with non-aromatic chlorinated hydrocarbon of at least about 30 carbon atoms.

The nitrogen-containing compositions of this invention can be added directly to the fuel or lubricating oil to form the fuel and lubricant compositions of this invention or they can be diluted with at least one substantially inert, normally liquid, organic solvent/diluent such as mineral oil, xylene, alcohol, nitro lower alkane, chloro lower alkane, or a normally liquid fuel as described above, to form an additive concentrate which is then added to the fuel or lubricating oil in sufficient amounts to form the inventive fuel and lubricant composition described herein. These concentrates generally contain about 20 to about 80 percent of the nitrogen-containing composition of this invention and can contain in addition any of the above-described conventional additives, particularly the afore-described ashless dispersants in the aforesaid proportions. The remainder of the concentrate is the solvent/diluent.

Examples of the lubricant and fuel compositions of this invention are the following:

Example A

A lubricant suitable for use as an automatic transmission fluid is made according to the following formulation:

| Component | Weight % |
|---|---|
| Mineral Base Oil | 88.07 |
| Product of Example 2 | 3.00 |
| Borated Succinic Acid/Polyamine Dispersant/Detergent | 1.00 |
| Thioglycol EP Agent | 0.295 |
| Sulfurized α-Olefin/Fatty Oil Mixture | 0.295 |
| Diphenyl Amine Anti-oxidant | 0.20 |
| Dialkyl Hydrogen Phosphite | 0.077 |
| Amino Surfactant | 0.01 |

-continued

| Component | Weight % |
|---|---|
| Diluent Oil | 0.533 |
| V.I. Improver | 3.25 |
| Seal Swelling Agent | 3.00 |
| Anti-foaming Agent | 0.02 |

Example B

A lubricant suitable for use as an automotive crankcase oil is made according to the following formulation:

| Component | Parts |
|---|---|
| Base Oil 10W-40 | 15336 |
| Acrylate V.I. Improver | 1448 |
| Borated Succinic Acid/Polyamine Dispersant/ Detergent | 307 |
| Sulfurized Hydrocarbon Anti-wear Agent | 248 |
| Phenolic Anti-oxidant | 293 |
| Carboxylic Acid Anti-rust Agent | 105 |
| Product of Example 3 | 1040 |
| Silicone Anti-foam Agent | 1.9 |

Example C

A fuel composition suitable for use in an automobile spark-ignited engine equipped with a carburetor is prepared by adding the product of Example 3 at a dosage rate equivalent to 26.2 pounds per 1000 barrels to a commercially available gasoline.

What is claimed is:

1. A nitrogen-containing composition substantially free of nitro groups made by condensing:

(A) at least one nitro phenol represented by the formula

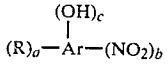

wherein R is a substantially saturated, substantially hydrocarbyl, nonaromatic substituent bonded to an aromatic ring carbon of Ar through a direct carbon bond; a is zero or an integer of 1 up to three times A where A is the number of aromatic nuclei present in Ar; b and c are each independently integers of 1 up to three times A with the proviso that the sum a+b+c does not exceed the unsatisifed valences of Ar; and Ar is an aromatic moiety having 0 to 3 optional substituents, Opt, selected from the group consisting of halogen, —L, —OL, —CN, —$NH_2$, —NHL, —$NL_2$, —C(O)OL where L is a lower alkyl group of 1 to 7 carbon atoms and combinations of two or more of said optional substituents with (B) at least one amine having at least one hydrogen atom directly bonded to a nitrogen atom or an oxygen atom.

2. A composition as described in claim 1 wherein a is not zero, R is a purely hydrocarbyl group and has an average of up to about 750 aliphatic carbon atoms.

3. A composition as described in claim 2 wherein R is an alkyl or alkenyl group having an average of about 10 to about 400 carbon atoms.

4. A composition as described in claim 3 wherein there are zero optional substituents.

5. A composition as described in claim 2 wherein R has an average of at least about 30 carbon atoms and is made from homopolymerized or interpolymerized $C_{2-10}$ mono- and diolefins.

6. A composition as described in claim 1 wherein the nitro phenol (A) is represented by the formula

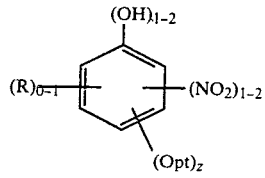

wherein R is a substantially saturated hydrocarbyl group having up to about 750 aliphatic carbon atoms and z is 0 or 1.

7. A composition as described in claim 6 wherein an R group is present and it is an alkyl or alkenyl group having an average of about 10 to about 400 carbon atoms.

8. A composition as described in claim 7 wherein z is 0.

9. A composition as described in claim 6 wherein the nitro phenol (A) is represented by the formula

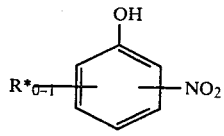

wherein R* is an alkyl or alkenyl group having an average of up to about 750 carbon atoms; the condensation of (A) with (B) takes place at a temperature of about 100° C. to about 200° C.; and the total amounts of (A) and (B) employed in the condensation are in the ratio of about 0.5–10 equivalents of (B) per mole of (A).

10. A composition as described in claim 9 wherein R* is present, has at least about 10 carbon atoms and located para to the phenolic hydroxyl group.

11. A composition as described in claim 1 wherein the amino compound (B) is at least one polyamine represented by the general formula

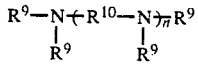

wherein n is an integer of 1 to about 10, $R^{10}$ is a divalent hydrocarbyl group of 1 to about 10 carbon atoms and each $R^9$ is a hydrogen atom, a lower hydrocarbyl group of 1 to 7 carbon atoms or lower hydroxyl-substituted hydrocarbyl group of 1 to 7 carbon atoms with the proviso that when none of the $R^9$ groups is a hydroxyl-substituted hydrocarbyl group, at least one of the $R^9$ groups is a hydrogen atom; or (B) is a hydroxyl-containing monoamine represented by the general formula $$(R^{12})_3N$$

wherein $R^{12}$ is independently chosen from the group consisting of hydrogen atoms, lower hydrocarbyl groups of 1 to about 20 carbon atoms and mono- and di-hydroxyl-substituted hydrocarbyl groups of 1 to about 20 carbon atoms with the proviso that at least one $R^{12}$ is said mono- or di-hydroxyl-substituted hydrocarbyl groups.

12. A composition as described in claim 11 wherein a is not zero, R is an alkyl or alkenyl group having an average of about 10 to about 400 carbon atoms.

13. A composition as described in claim 11 wherein the nitro phenol (A) is represented by the general formula

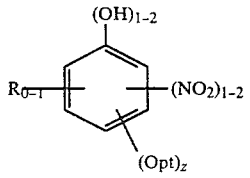

wherein R is a substantially saturated hydrocarbyl substituent having an average of from about 30 to about 750 aliphatic carbon atoms; and z is 0 or 1.

14. A composition as described in claim 13 wherein z is 0.

15. A composition as described in claim 13 wherein the nitro phenol (A) is represented by the general formula

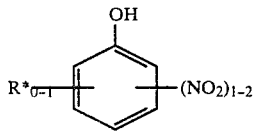

wherein R* is a hydrocarbyl alkyl or alkenyl group having an average of up to about 750 carbon atoms; the condensation of (A) with (B) takes place at a temperature of about 100° C. to about 200° C.; and the total amounts of (A) and (B) employed in the condensation are in the ratio of about 0.5–10 equivalents of (B) per mole of (A).

16. A composition as described in claim 11 wherein the amine (B) is an ethylene polyamine containing 2 to 10 nitrogen atoms and optionally 1 to 4 lower, monohydroxy alkyl substituents on said nitrogen atoms.

17. A composition as described in claim 16 wherein R is an alkyl or alkenyl group having an average of about 10 to about 300 carbon atoms.

18. A composition as described in claim 16 wherein the nitro phenol (A) is represented by the formula

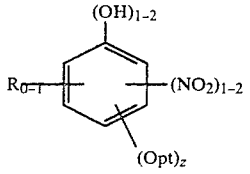

wherein R is a substantially saturated, substantially hydrocarbyl substituent having an average of up to about 750 aliphatic carbon atoms and z is 0 or 1.

19. A composition as described in claim 16 wherein z is 0.

20. A composition as described in claim 16 wherein the nitro phenol (A) is represented by the general formula

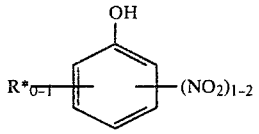

wherein R* is a hydrocarbyl alkyl or alkenyl group having an average of up to about 750 carbon atoms; the condensation of (A) with (B) takes place at a temperature of about 100° C. to about 200° C.; and the total amounts of (A) and (B) employed in the condensation are in the ratio of about 0.5–10 equivalents of (B) per mole of (A).

21. A fuel composition comprising a major amount of at least one normally liquid fuel and about 0.00001 to about 10% by weight of the nitrogen-containing composition described in claim 1.

22. A fuel composition comprising a major amount of at least one normally liquid fuel and about 0.00001 to about 10% by weight of the nitrogen-containing composition described in claim 3.

23. A fuel composition comprising a major amount of at least one normally liquid fuel and about 0.00001 to about 10% by weight of the nitrogen-containing composition described in claim 6.

24. A fuel composition comprising a major amount of at least one normally liquid fuel and about 0.00001 to about 10% by weight of the nitrogen-containing composition described in claim 13.

25. A fuel composition comprising a major amount of at least one normally liquid fuel and about 0.00001 to about 10% by weight of the nitrogen-containing composition described in claim 15.

26. A fuel composition comprising a major amount of at least one normally liquid fuel and about 0.00001 to about 10% by weight of the nitrogen-containing composition described in claim 19.

27. An additive concentrate for fuels and lubricants comprising about 20 to about 80 parts of a substantially inert, normally liquid solvent/diluent and about 80 to about 20 parts of the nitrogen-containing composition described in claim 1.

28. An additive concentrate for fuels and lubricants comprising about 20 to about 80 parts of a substantially inert, normally liquid solvent/diluent and about 80 to about 20 parts of the nitrogen-containing composition described in claim 3.

29. An additive concentrate for fuels and lubricants comprising about 20 to about 80 parts of a substantially inert, normally liquid solvent/diluent and about 80 to about 20 parts of the nitrogen-containing composition described in claim 6.

30. An additive concentrate for fuels and lubricants comprising about 20 to about 80 parts of a substantially inert, normally liquid solvent/diluent and about 80 to about 20 parts of the nitrogen-containing composition described in claim 13.

31. An additive concentrate for fuels and lubricants comprising about 20 to about 80 parts of a substantially inert, normally liquid solvent/diluent and about 80 to about 20 parts of the nitrogen-containing composition described in claim 15.

32. An additive concentrate for fuels and lubricants comprising about 20 to about 80 parts of a substantially inert, normally liquid solvent/diluent and about 80 to about 20 parts of the nitrogen-containing composition described in claim 19.

33. A lubricant composition comprising a major amount of at least one lubricating oil of lubricating viscosity and about 0.01 to about 20% by weight of the nitrogen-containing composition described in claim 1.

34. A lubricant composition comprising a major amount of at least one lubricating oil of lubricating viscosity and about 0.01 to about 20% by weight of the nitrogen-containing composition described in claim 3.

35. A lubricant composition comprising a major amount of at least one lubricating oil of lubricating viscosity and about 0.01 to about 20% by weight of the nitrogen-containing composition described in claim 6.

36. A lubricant composition comprising a major amount of at least one lubricating oil of lubricating viscosity and about 0.01 to about 20% by weight of the nitrogen-containing composition described in claim 13.

37. A lubricant composition comprising a major amount of at least one lubricating oil of lubricating viscosity and about 0.01 to about 20% by weight of the nitrogen-containing composition described in claim 15.

38. A lubricant composition comprising a major amount of at least one lubricating oil of lubricating viscosity and about 0.01 to about 20% by weight of the nitrogen-containing composition described in claim 19.

39. A method of preparing a nitrogen-containing composition substantially free of nitro groups which comprises the step of condensing:

(A) at least one nitro phenol represented by the formula

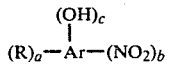

wherein R is a substantially saturated, substantially hydrocarbyl, nonaromatic substituent boned to an aromatic ring carbon of Ar through a direct carbon bond; a is zero or an integer of 1 up to three times A where A is the number of aromatic nuclei present in Ar; b and c are each independently integers of 1 up to three times A with the proviso that the sum a+b+c does not exceed the unsatisified valences of Ar; and Ar is an aromatic moiety having 0 to 3 optional substituents, Opt, selected from the group consisting of halogen, —L, —OL, —CN, —$NH_2$, —NHL, —$NL_2$, —C(O)OL where L is a lower alkyl group of 1 to 7 carbon atoms and combinations of two or more of said optional substituents with (B) at least one amino compound having at least one hydrogen atom directly bonded to a nitrogen atom or an oxygen atom.

40. A method as described in claim 39 wherein a is not zero, R is a purely hydrocarbyl group and has an average of up to about 750 aliphatic carbon atoms.

41. A method as described in claim 39 wherein a is not zero and R has an average of at least about 30 carbon atoms.

42. A method as described in claim 39 wherein the nitro phenol (A) is represented by the formula

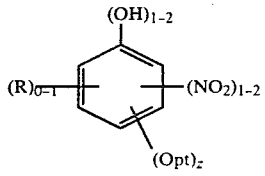

wherein R is a substantially saturated hydrocarbyl group having up to about 750 aliphatic carbon atoms and z is 0 or 1.

43. A method as described in claim 39 wherein the nitro phenol (A) is represented by the formula

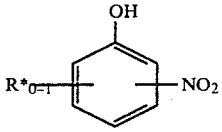

wherein R* is an alkyl or alkenyl group having an average of up to about 750 carbon atoms; the condensation of (A) with (B) takes place at a temperature of about 100° C. to about 200° C.; and the total amounts of (A) and (B) employed in the condensation are in the ratio of about 0.5–10 equivalents of (B) per mole of (A).

44. A method as described in claim 39 wherein the amino compound (B) is at least one polyamine represented by the general formula

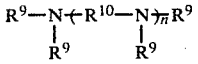

wherein n is an integer of 1 to about 10, $R^{10}$ is a divalent hydrocarbyl group of 1 to about 10 carbon atoms and each $R^9$ is a hydrogen atom, a lower hydrocarbyl group of 1 to 7 carbon atoms or lower hydroxyl-substituted hydrocarbyl group of 1 to 7 carbon atoms with the proviso that when none of the $R^9$ groups is a hydroxyl-substituted hydrocarbyl group, at least one of the $R^9$ groups is a hydrogen atom; or (B) is a hydroxyl-containing monoamine represented by the general formula

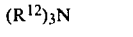

wherein $R^{12}$ is independently chosen from the group consisting of hydrogen atoms, lower hydrocarbyl groups of 1 to about 20 carbon atoms and mono- and di-hydroxyl-substituted hydrocarbyl groups of 1 to about 20 carbon atoms with the proviso that at least one $R^{12}$ is said mono- or di-hydroxyl-substituted hydrocarbyl groups.

45. A method as described in claim 43 wherein the amino compound (B) is at least one polyamine represented by the general formula

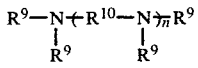

wherein n is an integer of 1 to about 10, $R^{10}$ is a divalent hydrocarbyl group of 1 to about 10 carbon atoms and each $R^9$ is a hydrogen atom, a lower hydrocarbyl group of 1 to 7 carbon atoms or lower hydroxyl-substituted hydrocarbyl group of 1 to 7 carbon atoms with the proviso that when none of the $R^9$ groups is a hydroxyl-substituted hydrocarbyl group, at least one of the $R^9$ groups is a hydrogen atom; or (B) is a hydroxyl-containing monoamine represented by the general formula

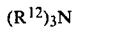

wherein $R^{12}$ is independently chosen from the group consisting of hydrogen atoms, lower hydrocarbyl groups of 1 to about 20 carbon atoms and mono- and di-hydroxyl-substituted hydrocarbyl groups of 1 to about 20 carbon atoms with the proviso that at least one $R^{12}$ is said mono- or di-hydroxyl-substituted hydrocarbyl groups.

* * * * *